US009962618B2

(12) United States Patent
Kafantaris et al.

(10) Patent No.: US 9,962,618 B2
(45) Date of Patent: May 8, 2018

(54) TOY VEHICLE

(71) Applicant: Mattel, Inc., El Segundo, CA (US)

(72) Inventors: Constantine Evangelos Kafantaris, Los Angeles, CA (US); Pak Keung Chu, Shatin, N.T. (HK)

(73) Assignee: Mattel, Inc., El Segundo, CA (US)

( * ) Notice: Subject to any disclaimer, the term of this patent is extended or adjusted under 35 U.S.C. 154(b) by 888 days.

(21) Appl. No.: 13/713,703

(22) Filed: Dec. 13, 2012

(65) Prior Publication Data

US 2013/0157541 A1 Jun. 20, 2013

Related U.S. Application Data

(60) Provisional application No. 61/576,660, filed on Dec. 16, 2011.

(51) Int. Cl.
*A63H 17/26* (2006.01)
*A63H 33/00* (2006.01)

(52) U.S. Cl.
CPC ..... *A63H 17/26* (2013.01); *A63H 33/003* (2013.01)

(58) Field of Classification Search
USPC ..... 446/93–96, 431, 230–232, 470; 244/2, 244/50, 46, 49; 280/1.12, 1.21
See application file for complete search history.

(56) References Cited

U.S. PATENT DOCUMENTS 1,681,438 A * 8/1928 Scourtes et al. ..... 280/7.16
2,791,867 A * 5/1957 Dasher ..... 446/95
2,793,045 A * 5/1957 Schuler ..... 280/1.21
3,005,639 A * 10/1961 Buttacavole et al. ..... 280/1.12
3,748,780 A * 7/1973 Glass et al. ..... 446/464
4,391,060 A * 7/1983 Nakane ..... 446/94
4,467,556 A * 8/1984 Iwao et al. ..... 446/230
4,477,999 A * 10/1984 Harigai et al. ..... 446/470
4,537,373 A * 8/1985 Butts ..... 244/22
4,543,073 A * 9/1985 Matsuda ..... 446/230
4,579,297 A * 4/1986 Ayoola ..... B60F 3/00 244/106
4,668,205 A * 5/1987 Choy et al. ..... 446/230
4,693,693 A * 9/1987 Kennedy et al. ..... 446/6
4,895,542 A * 1/1990 de Blanitza ..... 446/94
5,334,078 A * 8/1994 Hippely et al. ..... 446/470
5,580,296 A * 12/1996 Chow ..... 446/443
5,586,924 A * 12/1996 Huang ..... 446/462
5,735,727 A * 4/1998 Tsai ..... 446/462
5,785,572 A * 7/1998 Levy et al. ..... 446/144
(Continued)

*Primary Examiner* — Urszula M Cegielnik

(74) *Attorney, Agent, or Firm* — Edell, Shapiro & Finnan, LLC

(57) ABSTRACT

A reconfigurable toy vehicle is provided, the toy vehicle having: a first configuration and a second configuration; a main body portion, having a forward end, a rearward end and a pair of side members extending from the forward end to the rearward end; at least two telescopic wings attached to the main body portion; a retractable canopy movably secured to the main body portion, the retractable canopy being configured to cover a portion of the main body portion when the toy vehicle is in the second configuration; and a folding rear portion pivotally mounted to the main body portion, wherein movement of the folding rear portion causes the toy vehicle to transition between the first configuration to the second configuration.

20 Claims, 7 Drawing Sheets

(56) References Cited

U.S. PATENT DOCUMENTS

| | | | | |
|---|---|---|---|---|
| 5,803,790 | A * | 9/1998 | Tilbor et al. | 446/470 |
| 5,924,910 | A * | 7/1999 | Liu | 446/470 |
| 6,000,988 | A * | 12/1999 | Tsai | 446/231 |
| 6,102,771 | A * | 8/2000 | Poznick et al. | 446/465 |
| 6,834,835 | B1 * | 12/2004 | Knowles et al. | 244/198 |
| 7,252,264 | B2 * | 8/2007 | Nattinger | 244/2 |
| 7,722,426 | B2 * | 5/2010 | Campbell | 446/4 |
| 7,762,867 | B2 * | 7/2010 | Agostini et al. | 446/431 |
| 7,845,699 | B2 * | 12/2010 | Leopold | B60R 9/055 296/180.1 |
| 7,874,892 | B2 * | 1/2011 | Hippely | 446/429 |
| 7,950,977 | B2 * | 5/2011 | Sun et al. | 446/435 |
| 7,950,979 | B2 * | 5/2011 | Barthold | A63H 17/26 446/470 |
| 7,988,524 | B2 * | 8/2011 | Sitarski et al. | 446/470 |
| 8,267,347 | B2 * | 9/2012 | Goldshteyn | 244/2 |
| 8,272,920 | B2 * | 9/2012 | Sitarski et al. | 446/470 |
| 8,419,498 | B2 * | 4/2013 | Furusawa et al. | 446/71 |
| 2003/0094536 | A1 * | 5/2003 | LaBiche | 244/2 |
| 2006/0270310 | A1 * | 11/2006 | Campbell et al. | 446/268 |
| 2006/0270314 | A1 * | 11/2006 | Campbell et al. | 446/431 |
| 2006/0270315 | A1 * | 11/2006 | Campbell | 446/431 |
| 2006/0270316 | A1 * | 11/2006 | Campbell et al. | 446/431 |
| 2006/0270317 | A1 * | 11/2006 | Campbell | 446/431 |
| 2006/0270318 | A1 * | 11/2006 | Campbell | 446/431 |
| 2006/0270319 | A1 * | 11/2006 | Campbell | 446/431 |
| 2006/0270320 | A1 * | 11/2006 | Proch | 446/435 |
| 2009/0206192 | A1 * | 8/2009 | Sanderson et al. | 244/3.27 |
| 2013/0112804 | A1 * | 5/2013 | Zhu | 244/2 |

* cited by examiner

TOY VEHICLE

CROSS REFERENCE TO RELATED APPLICATIONS

This application claims the benefit of U.S. Provisional Patent Application Ser. No. 61/576,660 filed Dec. 16, 2011, the contents of which are incorporated herein by reference thereto.

BACKGROUND

Toy vehicles are popular and provide entertainment and excitement to a user. Toy vehicles can be used alone or with other toy vehicles and may be used in conjunction with track sets. In order to add additional play features to these toy vehicles it is desirable to provide them with additional features wherein the toy vehicle can change from one configuration to another configuration thus the user has in essence, two different types of toys provided by a single structure.

Accordingly, it is desirable to provide a toy vehicle that can transform from one configuration to another configuration.

BRIEF SUMMARY OF INVENTION

In one embodiment a toy vehicle is provided, the toy vehicle having: a first configuration and a second configuration; a main body portion, having a forward end, a rearward end and a pair of side members extending from the forward end to the rearward end; at least two telescopic wings attached to the main body portion; a retractable canopy movably secured to the main body portion, the retractable canopy being configured to cover a portion of the main body portion when the toy vehicle is in the second configuration; and a folding rear portion pivotally mounted to the main body portion, wherein movement of the folding rear portion causes the toy vehicle to transition between the first configuration to the second configuration.

In another exemplary embodiment a toy vehicle is provided, the toy vehicle having: a main body portion, having a forward end, a rearward end and a pair of side members extending from the forward end to the rearward end; a first pair of telescopic wings attached to the pair of side members for movement for movement between a first stowed position and a second deployed position as the toy vehicle moves from the first configuration to the second configuration; a second pair of telescopic wings attached to the pair of side members, wherein the first pair of telescopic wings are closer to the forward end than the second pair of telescopic wings, the second pair of telescopic wings being configured for movement between a first stowed position and a second deployed position as the toy vehicle moves from the first configuration to the second configuration; a retractable canopy movably secured to the main body portion, the retractable canopy being configured for movement between a first stowed position and a second deployed position as the toy vehicle moves from the first configuration to the second configuration; and a folding rear portion pivotally mounted to the main body portion, wherein movement of the folding rear portion causes the toy vehicle to transition between the first configuration to the second configuration by moving the first pair of telescopic wings, the second pair of telescopic wings and the retractable canopy movably from the first stowed position to the second deployed position as the folding rear portion is moved from a first position to a second position.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1A:
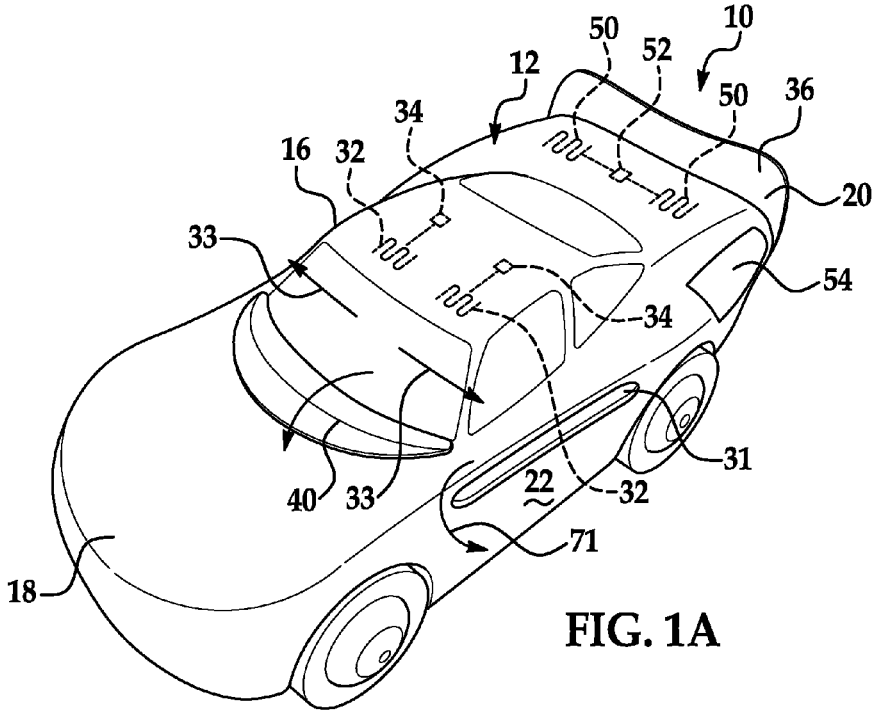
FIG. 1A is a perspective view of a toy vehicle in a first configuration.
Figure 1B:
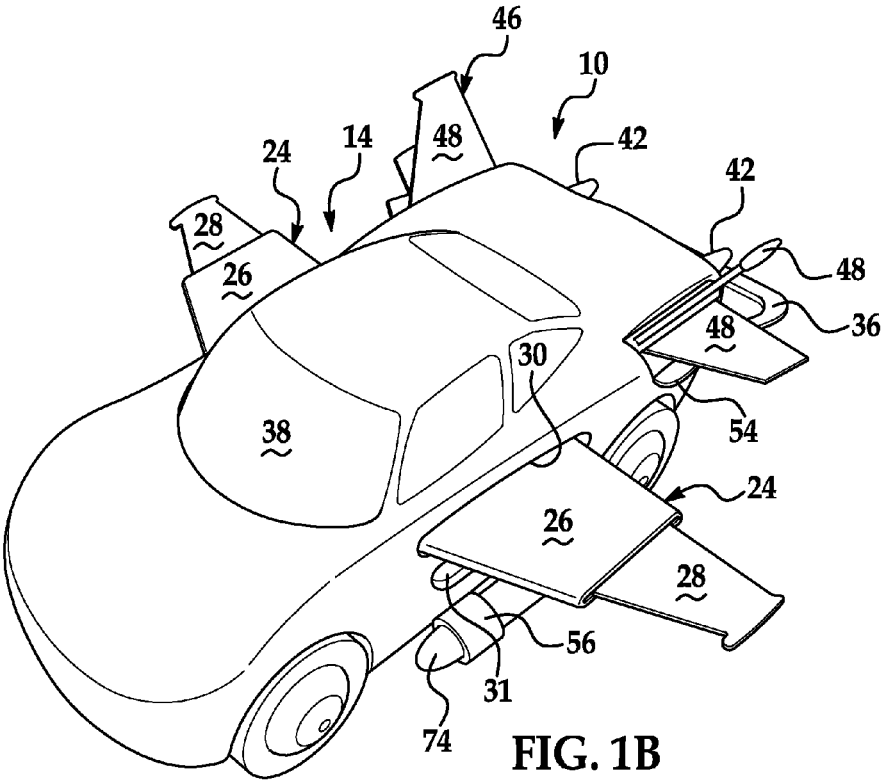
FIG. 1B is a perspective view of a toy vehicle in a second configuration.
Figure 2B:
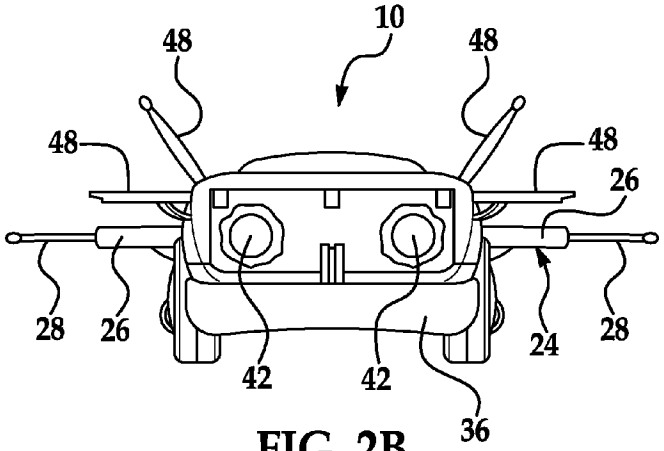
FIG. 2B is a rear view of the toy vehicle in the second configuration.
Figure 2D:
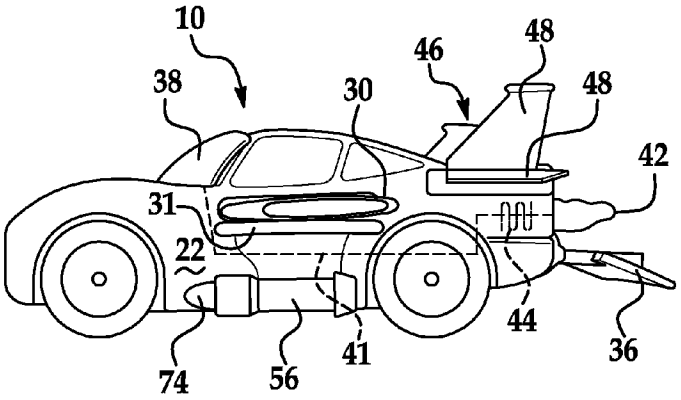
FIGS. 2C and 2D are side views of the toy vehicle in the second configuration.
Figure 2A:
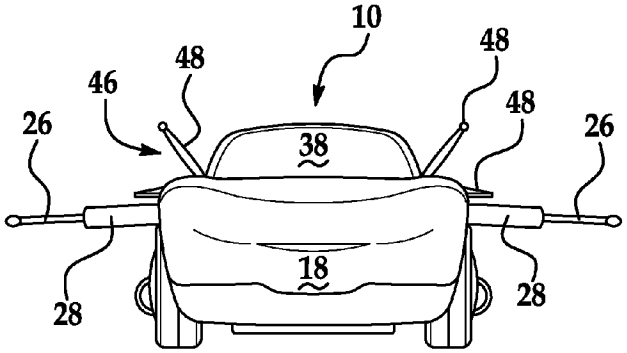
FIG. 2A is a front view of the toy vehicle in the second configuration.
Figure 2C:
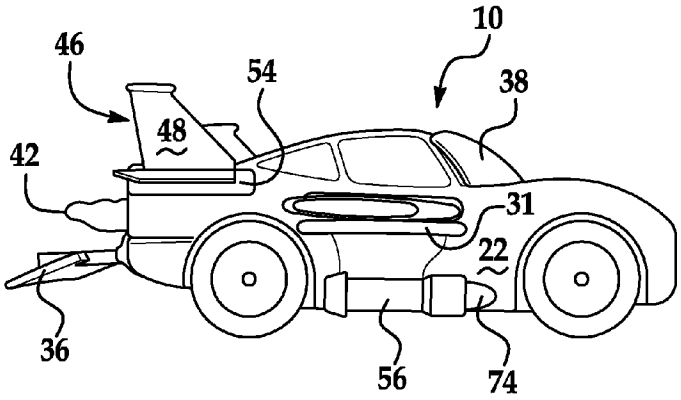
Figure 3A:
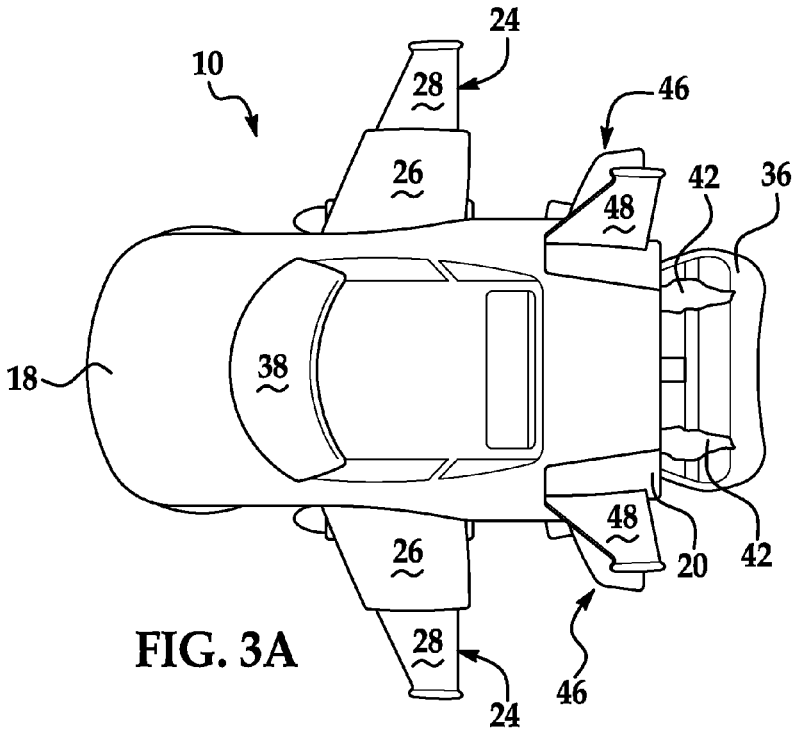
FIG. 3A is a top view of the toy vehicle in the second configuration.
Figure 3B:
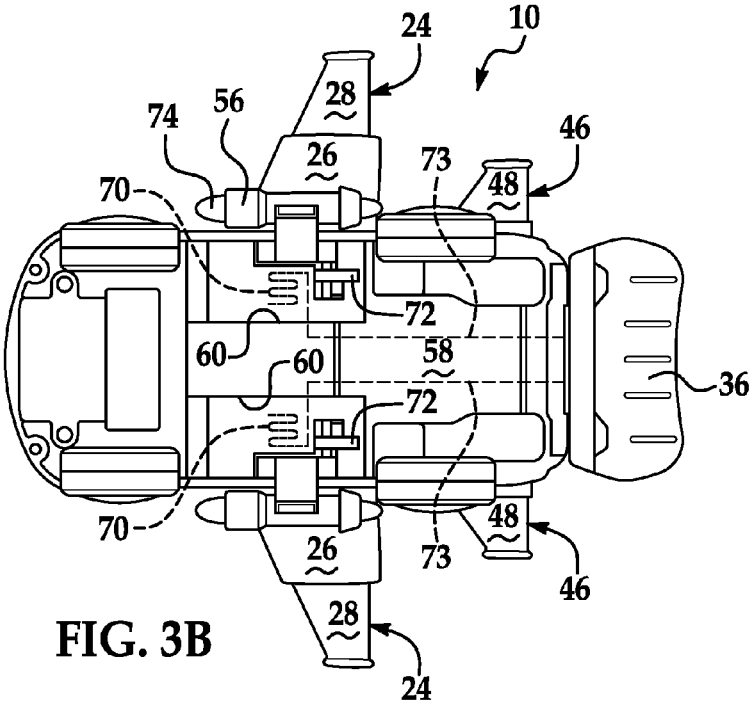
FIG. 3B is a bottom view of toy vehicle in the second configuration.
Figure 4A:
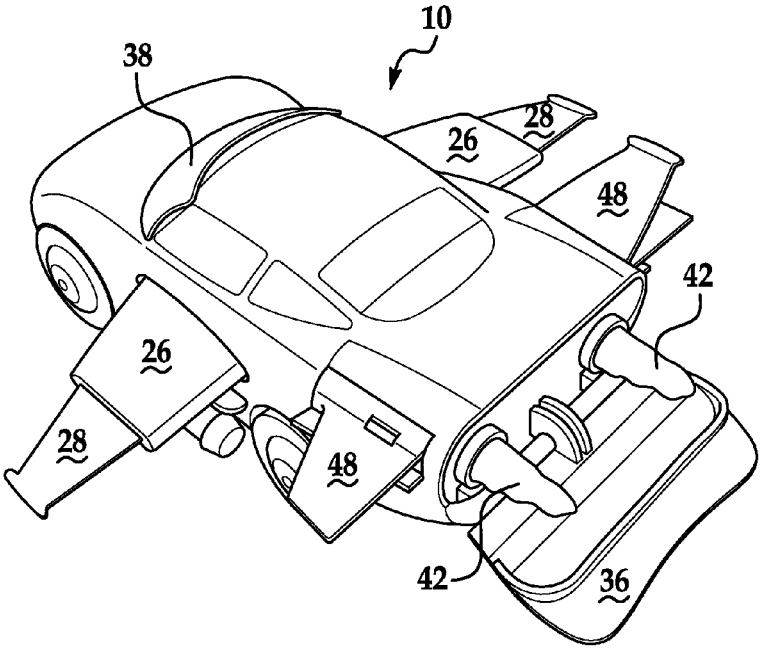
FIGS. 4A and 4B are perspective views of the toy vehicle in the second configuration.
Figure 4B:
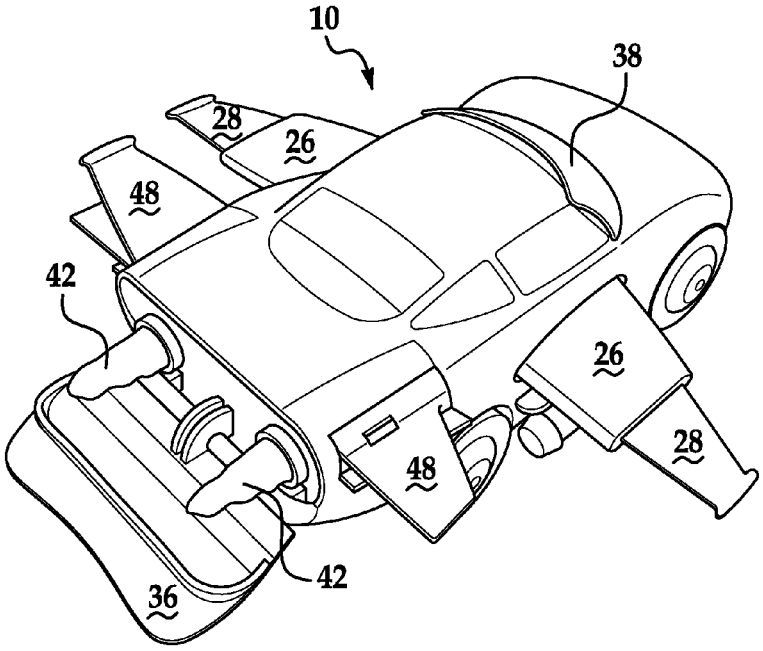

In accordance with an exemplary embodiment of the present invention a reconfigurable toy vehicle 10 is provided. The toy vehicle 10 is capable of transitioning from a first configuration 12 (see at least FIG. 1A) to a second configuration 14 (see at least FIG. 1B). In one embodiment, the toy vehicle 10 resembles a car, automobile or other land based vehicle in the first configuration 12 and the toy vehicle 10 resembles an airplane or other flying vehicle in the second configuration 14.

In one embodiment, the toy vehicle has a plurality of pop out or folding elements, features or components that transition from a first stowed position to a second deployed position when the toy vehicle transitions from the first configuration to the second configuration. Once deployed, at least some of the pop out or folding elements, features or components can be manually placed back into the first stowed position so that they can be subsequently released into the second or deployed position over and over again for enhanced play.

As illustrated, the toy vehicle 10 has a main body portion 16, a forward end 18, a rearward end 20 and a pair of side members 22 extending from the forward end 18 to the rearward end 20. In addition, the toy vehicle 10 also has a first pair of telescopic wings 24 attached to the main body portion 16. In one illustrated embodiment, the first pair of telescopic wings 24 each comprise a main wing portion 26 and a distal wing portion 28. The main wing portion 26 is slidably received within an opening 30 of side member 22 and the distal wing portion 28 is slidably received within main wing portion 26 such that they can transition between a first stowed position and a second deployed position as the vehicle transitions between the first configuration 12 and the second configuration 14. In the first stowed position corresponding to the first configuration 12, the main wing portion 26 and the distal wing portion 28 are nested within each other and the main body portion 16 of the vehicle 10. Also illustrated in the attached FIGS. is that a cover portion 31 is pivotally mounted to each of the side members 22 wherein the cover portion 31 covers opening 30 when the first pair of telescopic wings 24 are in the first stowed position thus concealing opening 30.

In one embodiment and in order to transition the first pair of telescopic wings 24 from the first stowed position to the second deployed position, a spring member 32 (illustrated schematically) is configured to provide a biasing force in the direction of arrows 33 urging the first pair of telescopic wings 24 from the first stowed position to the second deployed position. Spring member or members 32 is/are configured to be compressed when the first pair of telescopic wings 24 are inserted into the main body portion 16 thus creating a biasing force to move the first pair of telescopic wings 24 from the first stowed position to the second deployed position. In addition and in order to retain the first pair of telescopic wings 24 in the first stowed position against the biasing force of the spring(s) 32, a releasable catch 34 operatively coupled to the telescopic wings 24 is provided.

Releasable catch 34 is configured to releasably engage a feature of the first pair of telescopic wings 24 when they are in the first stowed position thus retaining the spring biasing force of spring 32 until releasable catch 34 is actuated.

As illustrated in the attached FIGS., the toy vehicle 10 is also provided with a folding rear portion 36 pivotally mounted to rear end 20 of the main body portion 16. Folding rear portion 36 is capable of movement from a first configuration (see at least FIG. 1A) to a second configuration (see at least FIG. 1B). In one non-limiting embodiment the folding rear portion 36 is linked or operatively coupled to the releasable catch 34 by linkage or any other suitable means such that movement of the folding rear portion 36 from the first configuration to the second configuration actuates or moves the releasable catch 34 and thus deploys the first pair of telescopic wings 24.

Accordingly and as folding rear portion 36 transitions from the first configuration to the second configuration, releasable catch 34 is actuated and the spring biasing force of springs 32 is/are released and the first pair of telescopic wings 24 transition from the first stowed position to the second deployed position as the toy vehicle transitions from the first configuration to the second configuration. In one embodiment, the folding rear portion 36 is configured to resemble a portion of a rear spoiler of the toy vehicle 10. Furthermore, the folding rear portion 36 is used as an actuation member, mechanism or trigger for transitioning the toy vehicle 10 from the first configuration to the second configuration.

Toy vehicle 10 is also provided with a retractable canopy 38 movably secured to the main body portion 16. In one embodiment, the retractable canopy 38 transitions from a first stowed position to a second deployed position as the toy vehicle transitions from the first configuration 12 to the second configuration 14. Retractable canopy 38 is coupled to folding rear portion 36 such that as the folding rear portion moves between the first configuration and the second configuration retractable canopy 38 moves between the first stowed position to the second deployed position (see at least FIGS. 4A-5F). As the retractable canopy 38 is moved between the first stowed position and the second deployed position, a front panel member 40 also moves from a first deployed position and a second stowed position. In other words, the front panel member 40 is stowed when the retractable canopy 38 is deployed and the front panel member is deployed when the canopy 38 is stowed. In one embodiment, member 40 is configured to cover the opening canopy 38 deploys from thus providing an aesthetically pleasing appearance.

In one embodiment, the retractable canopy 38 is provided with indicia to change the appearance of the toy vehicle as it transitions from the stowed position to the deployed position and vice versa. Thus, retractable canopy 38 changes the appearance of the toy vehicle 10 as it transitions from the first configuration to the second configuration.

Figure 5A:
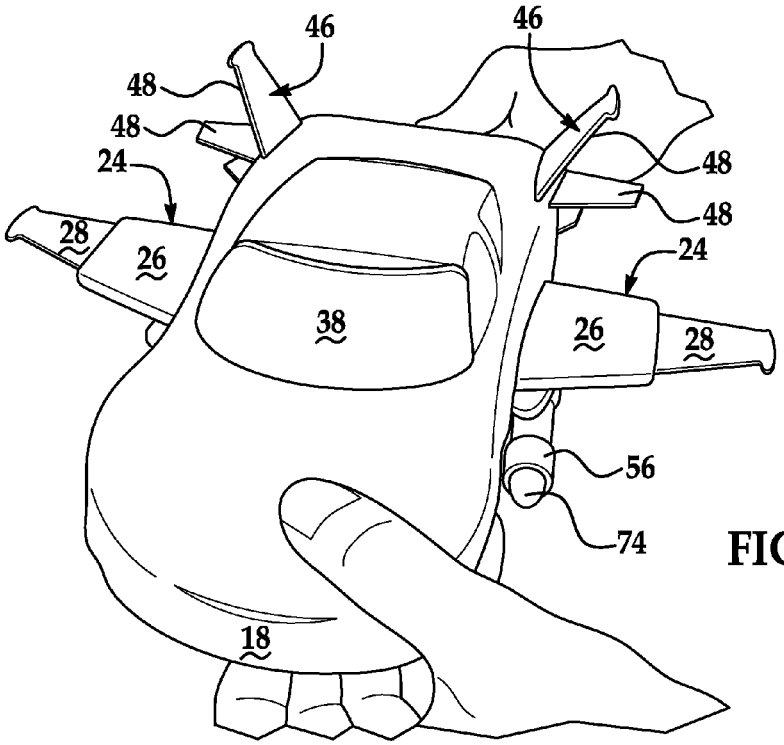
FIGS. 5A-5F illustrate additional features of the toy vehicle.
Figure 5B:
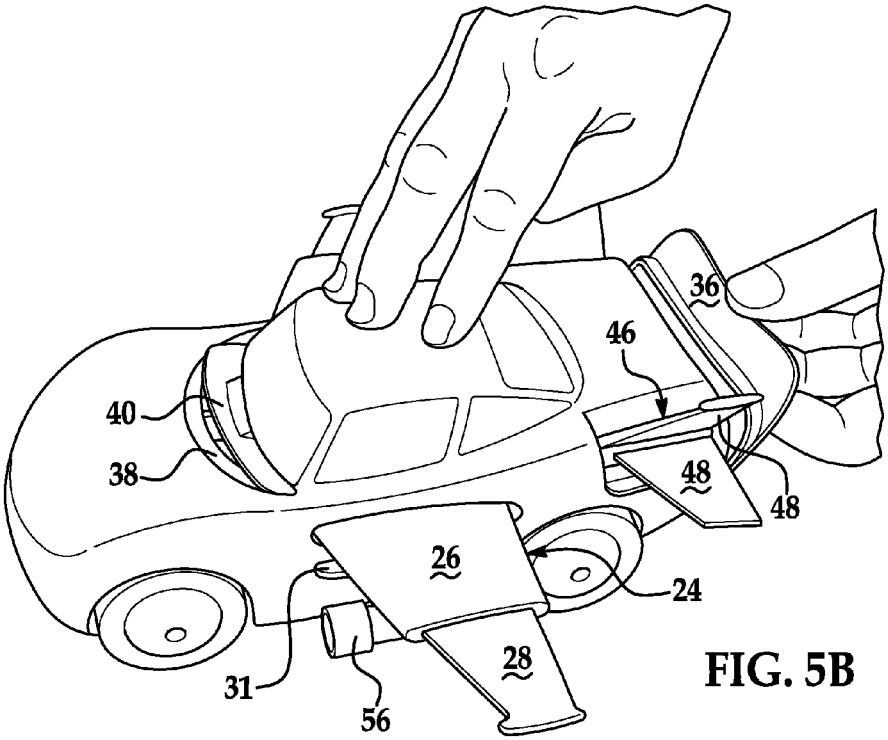
Figure 5C:
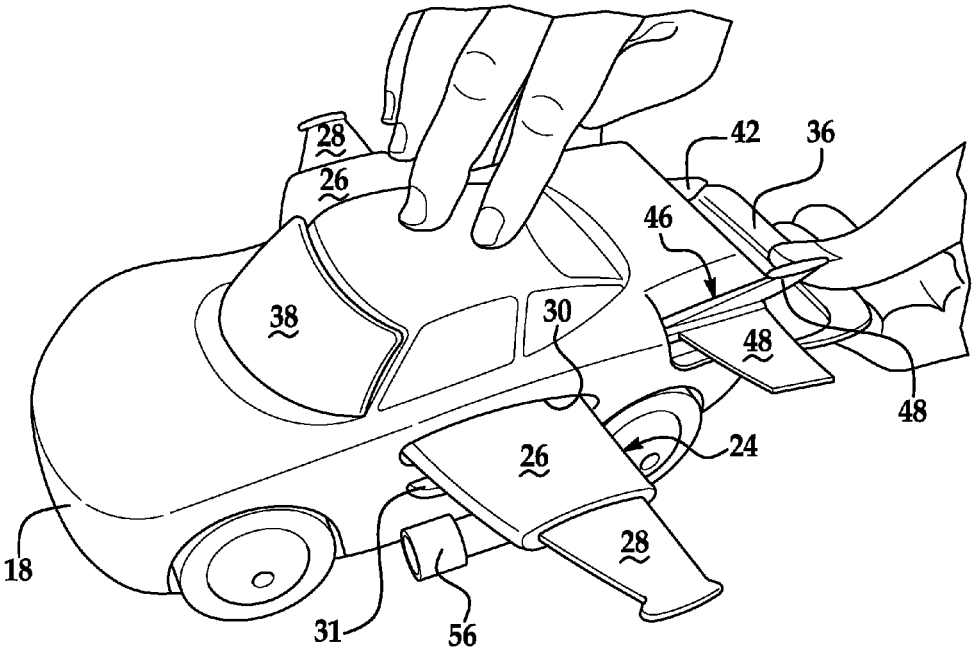
Figure 5D:
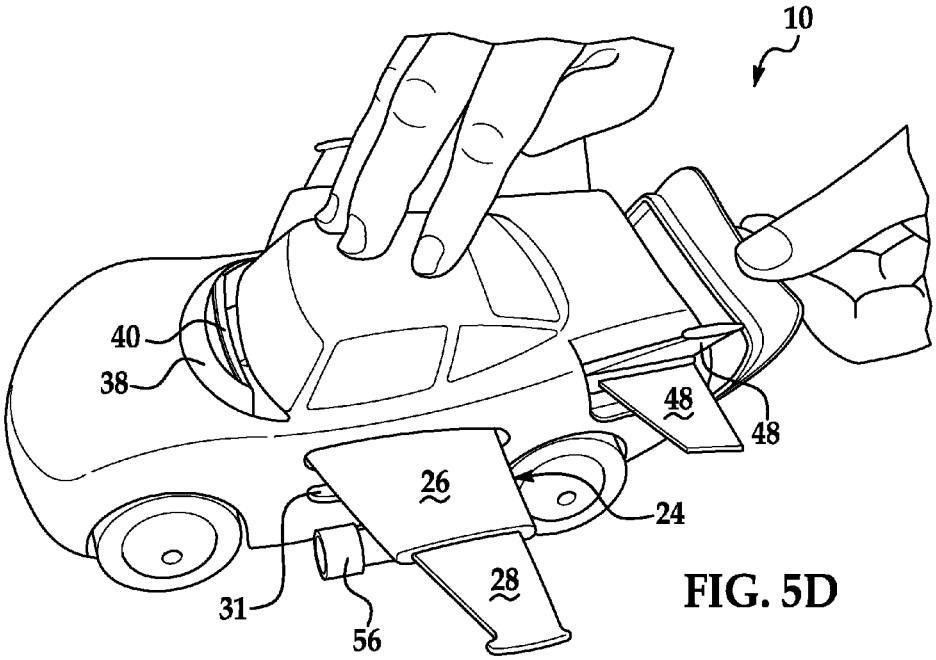
Figure 5E:
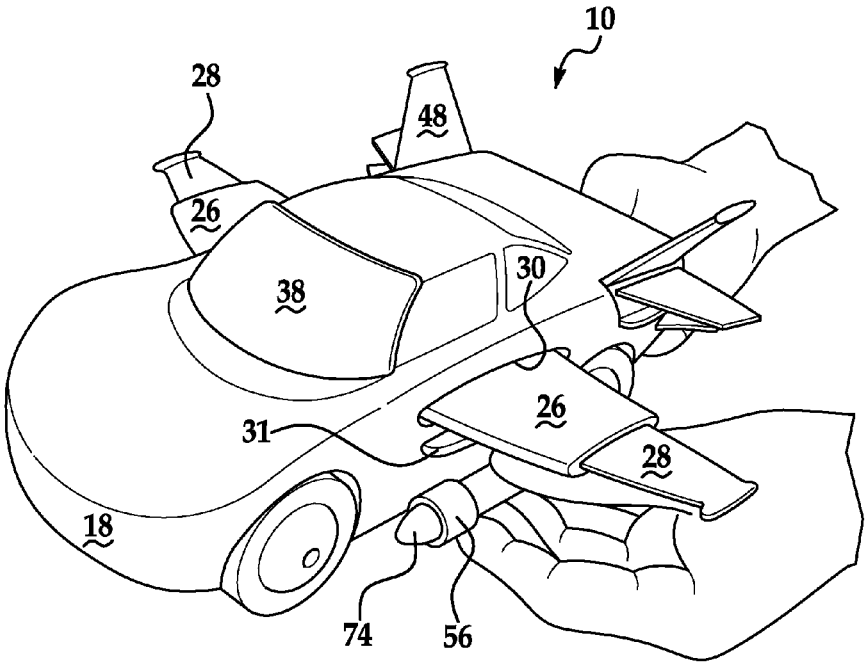
Figure 5F:
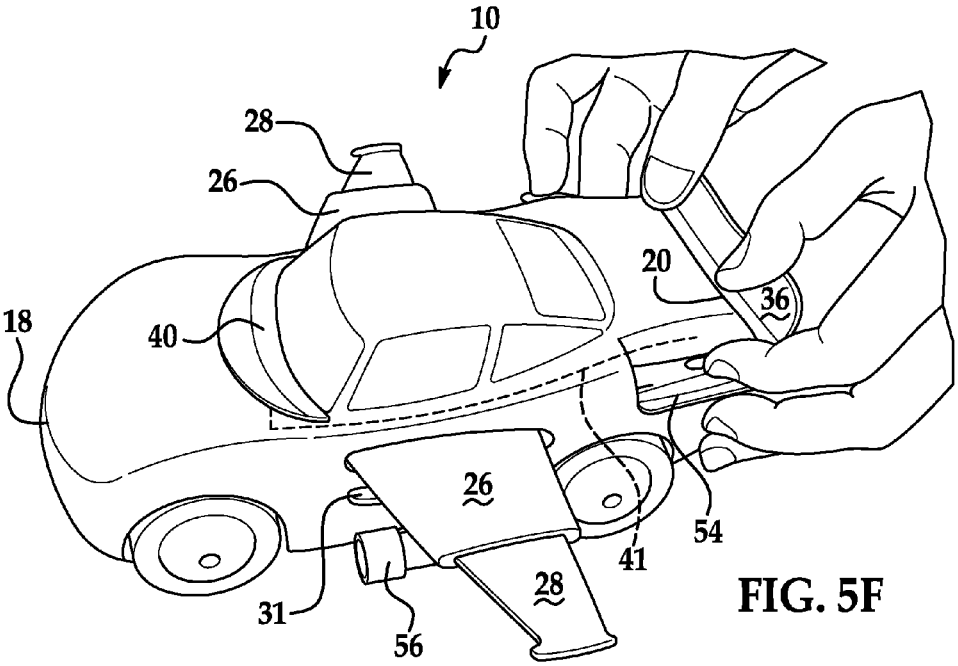

In FIG. 5A the toy vehicle 10 is in the second configuration wherein the first pair of telescopic wings 24 have been deployed into their second position corresponding to the second configuration of the toy vehicle. Also shown is that the retractable canopy 38 has been deployed and the front panel member 40 has been stowed. In addition, a pair of deployable features 42 have been released out of the rearward end 20 of the toy vehicle as the folding rear portion 36 has been moved from the first configuration and the second configuration. In one embodiment, the pair of deployable features 42 resemble flames or jets to give the toy airplane configuration an added feature.

In one embodiment, folding rear portion 36 is capable of being pivoted with respect to the toy vehicle. In one implementation and when all of the features of the toy vehicle are in their first position corresponding to the first configuration movement of the folding rear portion 36 causes the toy vehicle 10 to transition into the second configuration wherein all of the features and components move to their respective second positions. When the toy vehicle is in the second configuration the folding rear portion 36 can be pivotally moved by a user. This pivotal movement of the folding rear portion 36 when the toy vehicle is in the second configuration causes some portions of the toy vehicle to move as well while other portions remain in the second or deployed configuration. For example and as illustrated in at least FIGS. 5A-5F, when the folding rear portion moves from the second configuration (FIG. 5C) towards the first configuration (FIG. 5D), the retractable canopy 38 is stowed and the front panel member 40 is deployed and the pair of deployable features 42 are also pushed back into the rearward end 20. Accordingly, movement of the folding rear portion 36 causes complimentary movement of the front panel member 40, the retractable canopy 38 and the pair of features 42.

In one non-limiting embodiment and in order to achieve this movement, the pair of features 42 are coupled to retractable canopy 38 and the front panel member 40 via a linkage 41 such that movement of the pair of features 42 also causes movement of the retractable canopy 38 and the front panel member 40. Accordingly, movement of the folding rear portion 36 causes complimentary movement of the front panel member 40 and the retractable canopy 38.

In one embodiment, the pair of features 42 are spring biased into the second configuration by at least one biasing member or spring 44 such that as the folding rear portion 36 is pivoted into the second configuration the pair of features 42 are pushed out of the rearward end 20 of the toy vehicle 10 via the biasing force of spring 44. Still further and since the pair of features are coupled to the retractable canopy 38 and the front panel member 40 via a linkage or any other suitable item corresponding movement of the retractable canopy 38 and the front panel member 40 is achieved.

Alternatively, the folding rear portion 36 is directly coupled to the retractable canopy 38 and the front panel member 40 to achieve the desired movement. Of course, any other suitable means for coupling the folding rear portion 36 to the retractable canopy 38 and the front panel member 40 to achieve the desired movement is considered to be within the scope of exemplary embodiments of the present invention.

Also shown in the attached FIGS. and in one embodiment, is that the toy vehicle 10 further comprises a second pair of telescopic wings 46. The second pair of telescopic wings 46 are attached to the main body portion 16 for movement between a first stowed position corresponding to the first configuration 12 of the toy vehicle 10 and a second deployed position corresponding to the second configuration 14 of the toy vehicle 10. The first pair of telescopic wings 24 are positioned closer to the forward end 12 of the main body portion 16 than the second pair of telescopic wings 46. The second pair of telescopic wings 46 each comprise at least two wing elements 48 each pivotally mounted to each other and spring biased or configured such that as they transition from the first stowed position to the second deployed configuration, they are angularly orientated with respect to each other and when they moved back into the first stowed position they are placed adjacent to each other against the biasing force that urges them into the second deployed position.

Similar to the first pair of telescopic wings 24, and in order to move the second pair of telescopic wings 46 from the first stowed position to the second deployed position as the vehicle transitions from the first configuration to the second configuration, a spring member 50 is configured to provide a biasing force urging the second pair of telescopic wings 46 from the first stowed position to the second deployed position. Spring member or members 50 is/are configured to be compressed when the first pair of telescopic wings 46 are inserted into the main body portion 16 thus creating a biasing force to move the second pair of telescopic wings 46 from the first stowed position to the second deployed position as the vehicle transitions from the first configuration to the second configuration. In addition and in order to retain the second pair of telescopic wings 46 in the first stowed position, against the biasing force of the spring (s) 50, a releasable catch 52 is provided.

Releasable catch 52 is configured to releasably engage a feature of the second pair of telescopic wings 46 when they are in the first stowed position thus retaining the spring biasing force of spring 50 until releasable catch 52 is actuated.

In one embodiment and as folding rear portion 36 transitions from the first configuration to the second configuration, releasable catch 52 is actuated and the spring biasing force of spring(s) 50 is released and the second pair of telescopic wings 46 transition from the first stowed position to the second deployed position. Accordingly, releasable catch 52 is operatively connected to the second pair of telescopic wings 46 and the folding rear portion 36. As mentioned above with regard to the first pair of telescopic wings 24, the folding rear portion 36 is linked or operatively coupled to releasable catch 52 by linkage or any other suitable means such that movement of the same actuates releasable catch 52 such that the second pair of telescopic wings can be deployed.

Also illustrated in the attached FIGS. is that a cover portion 54 is pivotally mounted to each of the side members 22 wherein the cover portion 54 covers an opening the second pair of telescopic wings 46 are received in when they are in the first stowed position thus concealing the opening.

Also shown in the attached FIGS. and in one embodiment, is that the toy vehicle 10 further comprises a pair of projectile launchers 56 attached to the main body portion 16 for movement between a first stowed position corresponding to the first configuration 12 of the toy vehicle 10 and a second deployed position corresponding to the second configuration 14 of the toy vehicle 10. The pair of projectile launchers 56 are in one embodiment pivotally mounted to the bottom portion 58 of the toy vehicle 10.

When the pair of projectile launchers 56 are in the first stowed position they are received within a receiving area 60 of the bottom 58 of the toy vehicle 10 so that they do not contact a surface the toy vehicle is travelling on via its wheels. Similar to the first pair of telescopic wings 24 and in order to move the pair of projectile launchers 56 to the second deployed position a spring or other biasing member 70 is configured to provide a biasing force in the direction of arrow 71 urging the second pair of telescopic wings 46 from the first stowed position to the second deployed position. Spring or biasing members 70 is/are configured to be compressed or expanded when the pair of projectile launchers 56 are inserted into the receiving areas 60 of the main body portion 16 thus creating the biasing force to move the pair of projectile launchers from the first stowed position to the second deployed position as the vehicle transitions from the first configuration to the second configuration.

In addition and in order to retain the pair of projectile launchers 56 in the first position against the biasing force of the spring(s) 70, a releasable catch 72 is provided. Releasable catch 72 is configured to releasably engage a feature or portion of the pair of projectile launchers when they are in the first position thus restraining the spring biasing force of spring 70 until releasable catch 72 is actuated.

As in the previous embodiments, folding rear portion 36 is operatively coupled or linked to releasable catch 72 by linkage 73 or any other suitable means such that as the folding rear portion 36 transitions from the first configuration to the second configuration releasable catch 72 is actuated (e.g., moved from engagement with the portion or feature of the projectile launcher 56) and the spring biasing force of spring(s) 70 is released and the pair of projectile launchers 56 transition from the first position to the second position as the toy vehicle transitions from the first configuration to the second configuration.

Each of the projectile launchers 56 are configured to launch a projectile 74 via a spring biased launch mechanism or any other equivalent device known to those skilled in the related arts.

Accordingly and in one non-limiting embodiment, the toy vehicle 10 has a variety of pop-out and/or folding elements allowing for transformation of the toy vehicle 10 from an automobile (first configuration) into a jet airplane (second configuration). During this transformation from the first configuration to the second configuration and in one embodiment, the toy vehicle has two pairs of wings 24, 46 that deploy outward from a stowed position, a pair of flames or jet features 42 that deploy outward, a retractable canopy 38 that deploys and a pair of projectile launchers 56 that deploy outward. Once deployed, a user can manipulate the retractable canopy 38 between its deployed and stowed position while the two pairs of wings 24, 46 and the pair of projectile launchers 56 remain deployed outward.

As mentioned above with regard to the first pair of telescopic wings 24, the second pair of telescopic wings 46 and the pair of projectile launchers 56 the folding rear portion 36 is linked or operatively coupled to a corresponding releasable catch 34, 52 and 72 such that movement of the same actuates the releasable catches such that the variety of pop-out and/or folding elements are deployed allowing for transformation of the toy vehicle 10 from an automobile (first configuration) into a jet airplane (second configuration) . It is, of course, understood that numerous other means for actuating the variety of pop-out and/or folding elements are contemplated to be within the scope of various embodiments of the present invention for example, releasable catches 34, 52 and 72 can be combined into a single element that is actuated by folding rear portion 36 as it moves from the first configuration to the second configuration or alternatively the releasable catches 34, 52 and 72 alone or in combination as a single element can be actuated by features 42 as they are allowed to deploy outward from the rearward end 20 of the toy vehicle 10 as the folding rear portion 36 is moved. It being understood that movement of the folding rear portion 36 causes a corresponding movement of a releasable catch that once actuated allows a biasing force to deploy spring biased features and/or members. In addition and when the toy vehicle 10 is in the second configuration, additional movement of the folding rear portion 36 between the first configuration and the second configuration causes a corresponding movement of the retractable canopy 38. Still further and in yet another alternative embodiment, each of the releaseable catches may be operatively coupled to a button or trigger located on the vehicle. Here and once again, a single button or trigger may be employed or a plurality of triggers and buttons may be employed each being operatively couple to at least one moveable item of the toy vehicle.

Although one specific configuration or operation is illustrated, it is of course, understood that numerous other types of configurations are contemplated. In other words, the combination of deployable features and their operation may be varied.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated. This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A reconfigurable toy vehicle having a first configuration and a second configuration, the toy vehicle comprising:

a main body portion, having a forward end, a rearward end and a pair of side members extending from the forward end to the rearward end;

at least two telescopic wings attached to the main body portion, the at least two telescopic wings transition from a first stowed position to a second deployed position as the toy vehicle transitions from the first configuration to the second configuration;

a retractable canopy movably secured to the main body portion, the retractable canopy being configured to cover a portion of the main body portion when the toy vehicle is in the second configuration; and a folding rear portion pivotally mounted to the main body portion, wherein movement of the folding rear portion causes the toy vehicle to transition between the first configuration to the second configuration, wherein the toy vehicle resembles an automobile in the first configuration and the toy vehicle resembles an airplane in the second configuration.

2. The reconfigurable toy vehicle as in claim 1, wherein the at least two telescopic wings comprises a first pair of telescopic wings and wherein the toy vehicle further comprises a second pair of telescopic wings attached to the main body portion, wherein the first pair of telescopic wings are positioned closer to the forward end of the main body portion then the second pair telescopic wings.

3. The reconfigurable toy vehicle as in claim 2, wherein each of the second pair of telescopic wings further comprises at least two wing elements pivotally mounted to each other.

4. The reconfigurable toy vehicle as in claim 3, wherein the toy vehicle resembles an automobile in the first configuration and an airplane in the second configuration.

5. The reconfigurable toy vehicle as in claim 1, wherein the retractable canopy is in a first stowed position when the toy vehicle is in the first configuration and movement of the folding rear portion causes the retractable canopy to move between the first stowed position and a second deployed position wherein the retractable canopy covers the portion of the main body portion.

6. The reconfigurable toy vehicle as in claim 5, wherein the at least two telescopic wings each comprise a main wing portion and a distal wing portion, the main wing portion and the distal wing portion being slidably received within an opening in the main body portion such that they can transition from the first stowed position to the second deployed position as the vehicle transitions from the first configuration to the second configuration.

7. The reconfigurable toy vehicle as in claim 6, wherein the at least two telescopic wings are spring biased into the second deployed position and movement of the folding rear portion actuates a releasable catch that allows the at least two telescopic wings to move into the second deployed position.

8. The reconfigurable toy vehicle as in claim 5, wherein the at least two telescopic wings comprises a first pair of telescopic wings and wherein the toy vehicle further comprises a second pair of telescopic wings attached to the main body portion, wherein the first pair of telescopic wings are positioned closer to the forward end of the main body portion then the second pair of telescopic wings.

9. The reconfigurable toy vehicle as in claim 1, further comprising a pair of deployable features located behind the folding rear portion, wherein the pair of deployable features are spring biased from a first stowed position towards a second deployed position as the folding rear portion is pivoted away from a rearward end of the main body portion.

10. The reconfigurable toy vehicle as in claim 9, wherein at least one of the pair of deployable features is coupled to the retractable canopy and movement of the folding rear portion moves the retractable canopy via movement of the at least one of the pair of deployable features coupled to the retractable canopy.

11. The reconfigurable toy vehicle as in claim 10, wherein the retractable canopy is in a first stowed position when the toy vehicle is in the first configuration and movement of the folding rear portion causes the retractable canopy to move between the first stowed position and a second deployed position wherein the retractable canopy covers the portion of the main body portion.

12. The reconfigurable toy vehicle as in claim 10, wherein the at least two telescopic wings comprises a first pair of telescopic wings and wherein the toy vehicle further comprises a second pair of telescopic wings attached to the main body portion, wherein the first pair of telescopic wings are positioned closer to the forward end of the main body portion then the second pair of telescopic wings.

13. The reconfigurable toy vehicle as in claim 12, wherein each of the second pair of telescopic wings further comprises at least two wing elements pivotally mounted to each other and wherein the toy vehicle resembles an automobile in the first configuration and an airplane in the second configuration.

14. The reconfigurable toy vehicle as in claim 12, further comprising a pair of projectile launchers attached to the main body portion for movement between a first stowed position corresponding to the first configuration of the toy vehicle and a second deployed position corresponding to the second configuration of the toy vehicle, wherein the pair of projectile launchers are pivotally mounted to a bottom portion of the toy vehicle.

15. A reconfigurable toy vehicle having a first configuration and a second configuration, wherein the toy vehicle resembles an automobile in the first configuration and the toy vehicle resembles an airplane in the second configuration, the toy vehicle comprising:

a main body portion, having a forward end, a rearward end and a pair of side members extending from the forward end to the rearward end;

a first pair of telescopic wings attached to the pair of side members for movement for movement between a first stowed position and a second deployed position as the toy vehicle moves from the first configuration to the second configuration;

a second pair of telescopic wings attached to the pair of side members, wherein the first pair of telescopic wings are closer to the forward end than the second pair of telescopic wings, the second pair of telescopic wings being configured for movement between a first stowed position and a second deployed position as the toy vehicle moves from the first configuration to the second configuration;

a retractable canopy movably secured to the main body portion, the retractable canopy being configured for movement between a first stowed position and a second deployed position as the toy vehicle moves from the first configuration to the second configuration; and a folding rear portion pivotally mounted to the main body portion, wherein movement of the folding rear portion causes the toy vehicle to transition from the first configuration to the second configuration by moving the first pair of telescopic wings, the second pair of telescopic wings and the retractable canopy movably from the first stowed position to the second deployed position as the folding rear portion is moved from a first position to a second position.

16. A reconfigurable toy vehicle as in claim 15, wherein movement of the folding rear portion between the first position and the second position when the toy vehicle is in the second configuration causes the retractable canopy to move between the first stowed position and the second deployed position.

17. The reconfigurable toy vehicle as in claim 15, further comprising a pair of projectile launchers attached to the main body portion for movement between a first stowed position corresponding to the first configuration of the toy vehicle and a second deployed position corresponding to the second configuration of the toy vehicle, wherein the pair of projectile launchers are pivotally mounted to a bottom portion of the toy vehicle.

18. The reconfigurable toy vehicle as in claim 15, wherein each of the second pair of telescopic wings further comprises at least two wing elements pivotally mounted to each other.

19. The reconfigurable toy vehicle as in claim 1, wherein the retractable canopy is provided with indicia to change the appearance of the toy vehicle as the toy vehicle transitions from the first configuration to the second configuration.

20. The reconfigurable toy vehicle as in claim 15, wherein the retractable canopy is provided with indicia to change the appearance of the toy vehicle as the retractable canopy transitions from the first stowed configuration to the second deployed configuration.

* * * * *